US007268769B2

(12) United States Patent
Kogoh et al.

(10) Patent No.: US 7,268,769 B2
(45) Date of Patent: Sep. 11, 2007

(54) OPERATION PANEL AND IMAGE FORMATION APPARATUS OR ELECTRONIC EQUIPMENT USING THE OPERATION PANEL

(75) Inventors: Shinya Kogoh, Yokohama (JP); Toshihiko Matsuo, Yokohama (JP); Ko Takeuchi, Yokohama (JP); Toshimitsu Kobayashi, Iwatsuki (JP)

(73) Assignee: Fuji Xerox Co., Ltd., Tokyo (JP)

( * ) Notice: Subject to any disclaimer, the term of this patent is extended or adjusted under 35 U.S.C. 154(b) by 530 days.

(21) Appl. No.: 10/732,258

(22) Filed: Dec. 11, 2003

(65) Prior Publication Data

US 2004/0239633 A1 Dec. 2, 2004

(30) Foreign Application Priority Data

May 27, 2003 (JP) ..... 2003-149914

(51) Int. Cl.

| | |
|---|---|
| ***G09G 5/00*** | (2006.01) |
| ***B41J 29/00*** | (2006.01) |
| ***G03G 15/00*** | (2006.01) |
| *H01H 9/26* | (2006.01) |
| *H01H 13/72* | (2006.01) |

(52) U.S. Cl. ..... 345/168; 399/81

(58) Field of Classification Search ..... 345/168, 345/156; D18/54, 55, 50, 14, 18, 36, 40–41; 399/81

See application file for complete search history.

(56) References Cited

U.S. PATENT DOCUMENTS

| | | | | |
|---|---|---|---|---|
| 4,361,725 | A * | 11/1982 | Dagnelie et al. | 345/173 |
| 4,562,482 | A * | 12/1985 | Brown | 348/836 |
| 4,669,789 | A * | 6/1987 | Pemberton | 312/223.3 |
| 6,206,593 | B1 * | 3/2001 | Brenner et al. | 400/693 |
| 6,259,866 | B1 * | 7/2001 | Kabumoto et al. | 399/1 |
| 6,819,891 | B2 * | 11/2004 | Suzuki | 399/81 |
| 2002/0191980 | A1 * | 12/2002 | Kudo | 399/81 |

FOREIGN PATENT DOCUMENTS

| | | | |
|---|---|---|---|
| JP | 11119498 | A * | 4/1999 |
| JP | 2003098908 | A * | 4/2003 |

* cited by examiner

*Primary Examiner*—Amr A. Awad
*Assistant Examiner*—Stephen G Sherman
(74) *Attorney, Agent, or Firm*—Oliff & Berridge, PLC

(57) ABSTRACT

A display section of an operation panel is raised relative to a horizontal plane. If the display section consists of a liquid crystal having an angle of visibility of 80 degrees (i.e., with an angle formed between the line normal to the display surface of the display section and the visibility range limit being 40 degrees), the display section is raised at about 50 degrees relative to the horizontal plane, so that visibility can be ensured both at the wheelchair seated position and at the standing position at which the non-handicapped person stands up. Further, by arranging visual recognition keys (a menu key etc.) which require an operator to view the display section during operation thereof outside of a projection region of the display section, the operator's hand on the operation panel never hides the display section during operation.

6 Claims, 15 Drawing Sheets

FIG.7A

| | | | | |
|---|---|---|---|---|
| L | 262 | | | |
| x | 990 | 1020 | 1115 | 1205 |
| y | 1013 | | | |
| z | 1178 | | | |
| $\alpha$ | 40 | | | |
| A≦ | 58 | 59 | 62 | 65 |
| A≧ | 45 | 52 | 71 | 86 |

FIG.7B

| | | | | |
|---|---|---|---|---|
| L | 262 | | | |
| x | 990 | 1020 | 1115 | 1205 |
| y | 1013 | | | |
| z | 1178 | | | |
| $\alpha$ | 60 | | | |
| A≦ | 78 | 79 | 82 | 85 |
| A≧ | 45 | 52 | 71 | 86 |

OPERATION PANEL AND IMAGE FORMATION APPARATUS OR ELECTRONIC EQUIPMENT USING THE OPERATION PANEL

CROSS-REFERENCE TO RELATED APPLICATION

This application claims priority under 35 USC 119 from Japanese Patent Application No. 2003-149914, the disclosures of which are incorporated by reference herein.

BACKGROUND OF THE INVENTION

1. Field of the Invention

The present invention relates to an operation panel including a display section on which a content of operation inputted at an operation section is displayed and an image formation apparatus or an electronic equipment using this operation panel.

2. Description of the Related Art

Conventionally, there is known an operation panel which includes a variable mechanism for changing a standing angle of a display section relative to a horizontal plane so as to maintain visibility of the operation panel both at a seated position at which an operator is seated in a wheelchair or the like and at a standing position at which the operator stands up. However, it is not preferable to provide the variable mechanism because the cost of the operation panel is disadvantageously pushed up and an electric wire is possibly broken if the electric wire is bent so as to change the display section standing angle. Further, with the operation panel with the display section standing angle fixed, it is difficult to ensure good visibility both at the wheelchair seated position and at the standing position.

In recent years, an operation panel operable even by a physically handicapped person has been on demand, following a request for a universal design of the operation panel. To this end, an operation key operable by a mouth stick held by the mouth of a person with a disabled hand or a head stick fixed at person's head when used is desired.

Japanese Patent Application Laid-Open (JP-A) No. 2002-103732 discloses an operation panel 106 which includes a print key 100 provided to be protruded, made large in size, and made conspicuous by vivid color or display, as compared with other keys 102 and 104, as shown in FIG. 14, so that a user's attention is drawn to the print key 100. With this configuration, however, the print key 100 can be made more conspicuous than the other keys 102 and 104 only at the standing position. Therefore, if the operator is seated in the wheelchair, the operator may possibly be unable to visually recognize the print key 100.

JP-A No. 2002-236536 discloses a structure in which, as shown in FIGS. 15A and 15B, a finger rest section 116 is provided in the middle of an upper button 108, a lower button 110, a left button 112, and a right button 114 and an operator can operate the upper button 108, the lower button 110, the left button 112 or the right button 114 without significantly changing a finger position while the operator's finger continues to stay at this finger rest section 116. The object of this configuration is, however, to eliminate the operator's fatigue or feeling troublesome caused by the movement of the finger and not to facilitate easy handling of a mouth stick, a head stick or the like.

SUMMARY OF THE INVENTION

In light of the above-stated circumstances, it is an object of the present invention to provide an operation panel which can ensure visibility both at a wheelchair seated position and at a standing position and can be easily operated by a handicapped person and to provide an image formation apparatus or electronic equipment using including this operation panel.

According to an aspect of the invention, there is provided an operation panel including an operation section; and a display section which displays a content of operation effected at the operation section, wherein the display section is raised, at a predetermined standing angle with respect to a horizontal plane, so that the display section can be visually recognized both from a wheelchair seated position viewpoint and from a standing position viewpoint in accordance with an angle of visibility of the display section, while the operation panel is attached to an apparatus main body.

According to the present invention, the display section is raised, at a predetermined standing angle with respect to a horizontal plane, so that the display section can be visually recognized both from a wheelchair seated position viewpoint and from a standing position viewpoint in accordance with an angle of visibility of the display section, while the operation panel is attached to an apparatus main body. Therefore, even when the angle of visibility of the display section is small and the operator is seated in a wheelchair, the operator can visually recognize the display section without fail. Further, at this standing angle of the display section, the operator at the standing position can also visually recognize the display section. Accordingly, the operation panel compliant with a so-called universal design, which imposes no discrimination among the handicapped, the elderly, and the non-handicapped, can be provided.

BRIEF DESCRIPTION OF THE DRAWINGS

FIGS. 7A and 7B respectively illustrate results of calculations made to obtain the standing angle of the display section of the operation panel in the embodiment of the invention.

DETAILED DESCRIPTION OF THE INVENTION

An image formation apparatus which uses an operation panel in one embodiment of the invention will be described hereinafter.

Figure 3:
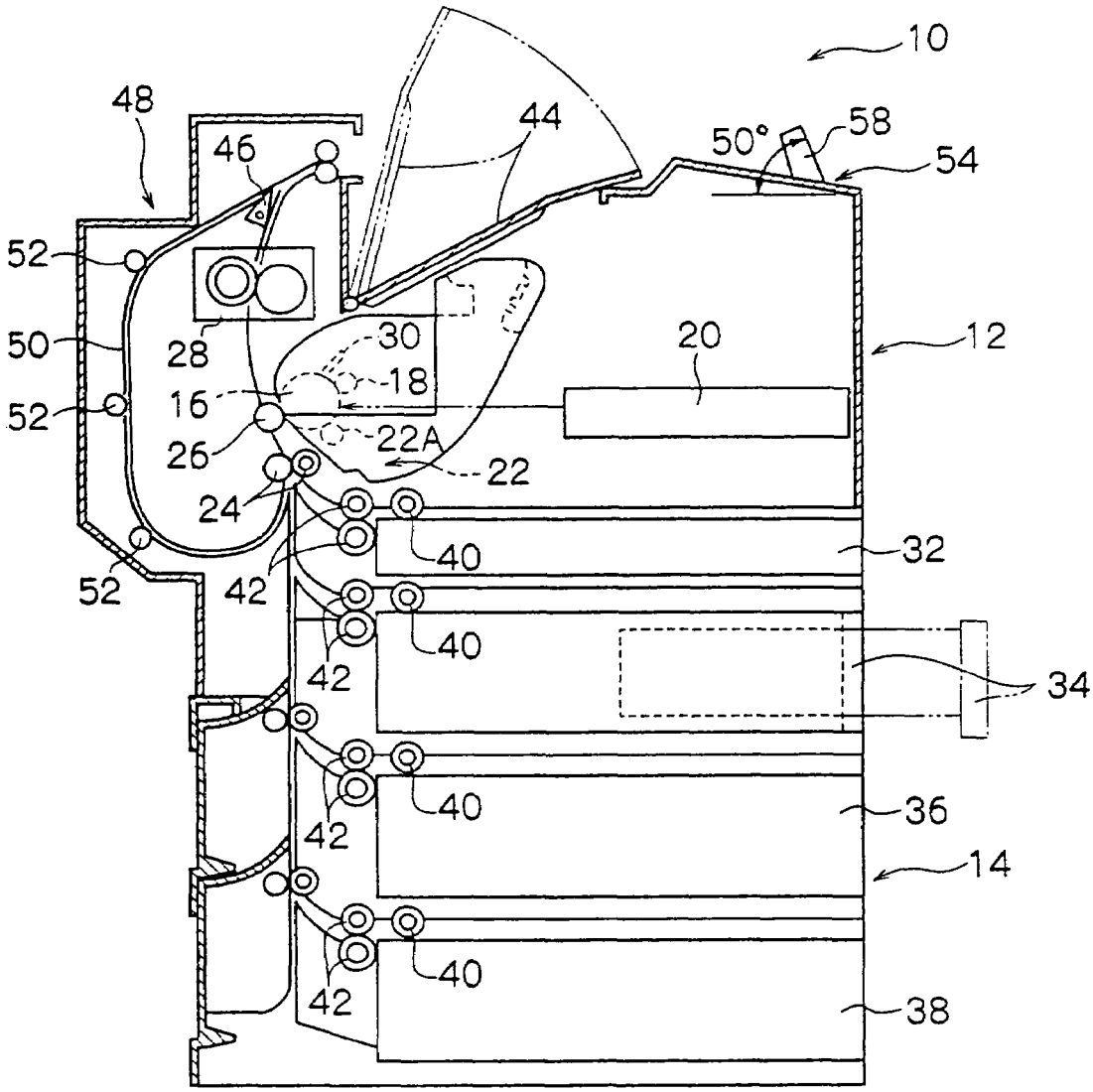
FIG. 3 is an explanatory view which schematically illustrates the image formation apparatus to which the operation panel in the embodiment of the invention is attached.

The outline of the image formation apparatus will first be described. As shown in FIG. 3, the image formation apparatus 10 consists of an image formation apparatus main body 12 and a paper feeder 14. The image formation apparatus main body 10 includes an image carrier 16 on a surface of which an electrostatic image is formed by uniformly electrifying the surface of the carrier 16 and emitting an image light thereto, an electrifier 18 which uniformly electrifies the surface of the image carrier 16, an optical box 20 which irradiates the image carrier 16 with the image light based on image data and which forms a latent image by a difference in electrostatic potential, a developer 22 which selectively transfers a toner onto the latent image to visualize the image, a transfer device 26 which transfers a toner image (an unfixed image) on the surface of the image carrier 16 onto a sheet fed by a resist roller 24, a fixing device 28 which heats and pressurizes the toner image on the sheet to fixedly melt the toner image, and a cleaner 30 which cleans the toner remaining on the image carrier 16 after the toner image is transferred.

The image carrier 16 has a photosensitive layer on its surface and a potential of an exposure section thereof attenuates by exposure after uniform electrification. The electrifier 18 is a rolled member abutted on the image carrier 16. By applying a voltage between the image carrier 16 and the electrifier 18, discharge occurs in a very small gap near an abutment portion and the surface of the image carrier 16 is electrified substantially uniformly. As the electrifier, an electrifier that applies a high voltage to an electrode wire and that electrifies the image carrier 16 by corona discharge can be used besides the electrifier described above.

The optical box 20 allows a flashing laser light to be scanned relative to a peripheral surface of the image carrier 16 to thereby form the electrostatic latent image based on the image data on the peripheral surface of the image carrier 16. As the optical box 20, a device which has a light emitting element such as an LED arranged thereon and which flickers the element based on image data can be used.

The developer 22 includes a cylindrical development roller 22A arranged to be proximate to and face the image carrier 16. A development bias voltage is applied between the development roller 22A and the image carrier 16. By applying the development bias voltage, a development bias electric field is generated between the development roller 22A and the image carrier 16 and the charged toner is transferred to the exposure section on the image carrier 16, thereby forming a visible image.

The transfer device 26 is a rolled member provided to face the image carrier 16. By forming a transfer electric field between the transfer device 26 and the image carrier 16, the toner image is transferred onto a passing sheet.

After the toner image is transferred onto the sheet by the transfer device 26, the sheet is separated from the image carrier 16. The separated sheet is transported to the fixing device 28, heated, pressurized and fixed by the fixing device 28, and discharged onto a discharge tray 44. Further, after the toner image is transferred onto the sheet, the surface of the image carrier 16 is cleaned by the cleaner 30 in preparation for the next image forming processing.

The paper feeder 14 which feeds sheets into the image formation apparatus main body 12 one by one is provided below the image formation apparatus main body 12. This paper feeder 14 includes detachable trays 32, 34, 36, and 38 which can be pulled out in an opposite direction to a sheet feed-out direction.

The tray 32 has a capacity of 150 sheets. The tray 34 has a capacity selectable between a capacity of 250 sheets and a capacity of 550 sheets. The trays 36 and 38 are optional and each has a capacity of 550 sheets.

Paper feed rollers 40 for feeding sheets from the trays 32, 34, 36, and 38 are provided near tip end portions of the trays 32, 34, 36, and 38, respectively. Handling members (not shown) pressure-fitted by the paper feed rollers 40 are provided on tip end sides of the trays 32, 34, 36, and 38, respectively, thereby feeding the sheets in the tray 32, 34, 36 or 38 one by one.

The sheet fed from the paper feeder 14 is transported to a toner image transfer position at a predetermined timing by the resist roller 24 provided near the paper feeder 14.

If double sided printing is performed, the sheet having an image fixed to one side is transported to a double sided printing transport unit 48 by changing a transport direction by a switching gate 46 without directly discharging the sheet to the discharge tray 44. In this double sided printing transport unit 48, transport rollers 52 provided along a transport path 50 transport the sheet to the resist roller 24 again with the sheet turned inside out, an image is transferred and fixed onto a rear side of the sheet, and then the sheet is discharged to the discharge tray 44.

An extension tray 45 is provided on a front surface side of the image formation apparatus 10 so that the tray 45 can be freely input and output. When a large-sized sheet (which is a sheet having a large sheet length such as an A3 or Legal size sheet) is used, by drawing the extension tray 45 out, the sheet is prevented from falling down from the image formation apparatus 10.

An operation panel in one embodiment of the invention will next be described.

Figure 1:
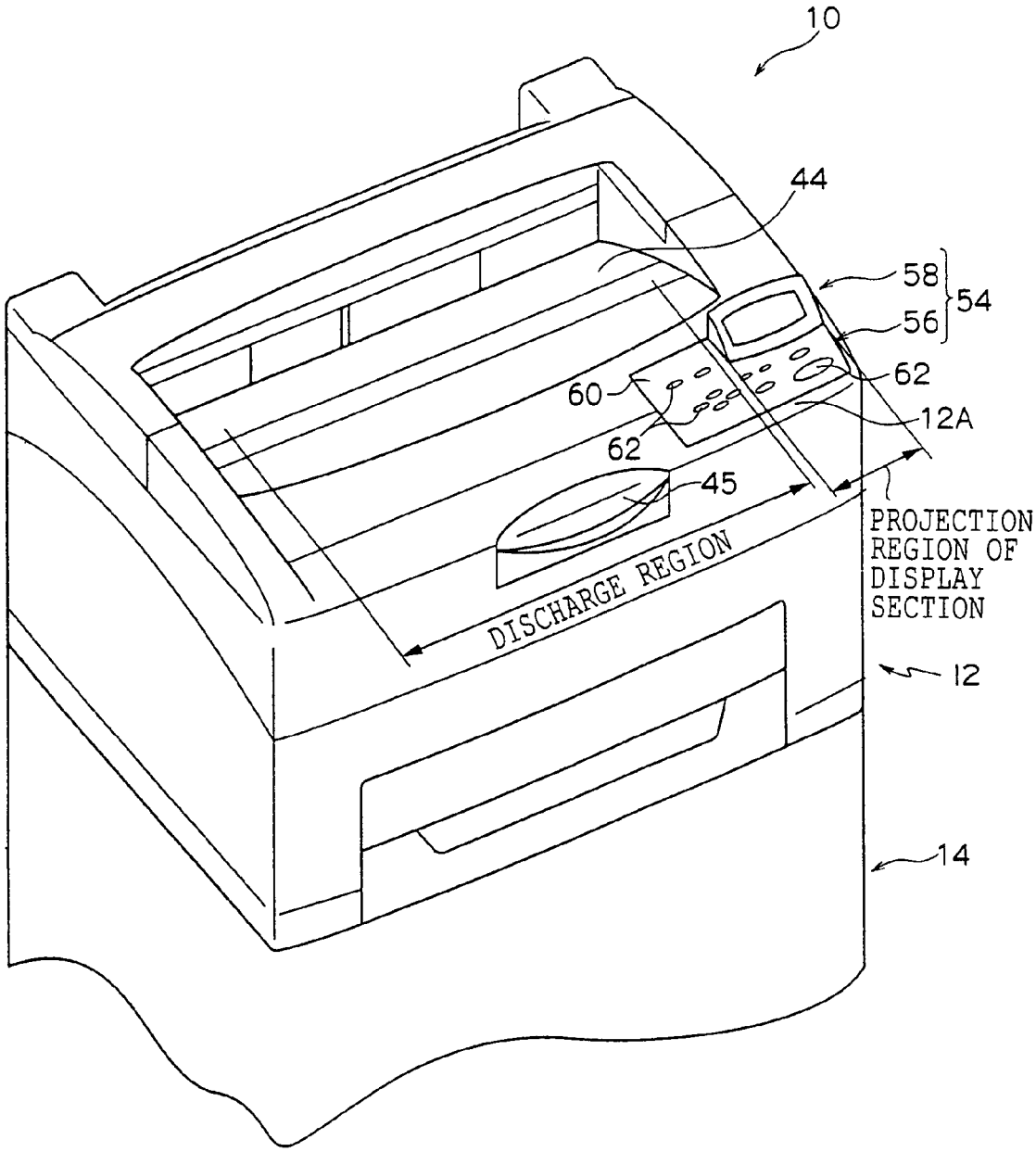
FIG. 1 is a perspective view which illustrates an image formation apparatus to which an operation panel in one embodiment of the present invention is attached.
Figure 2:
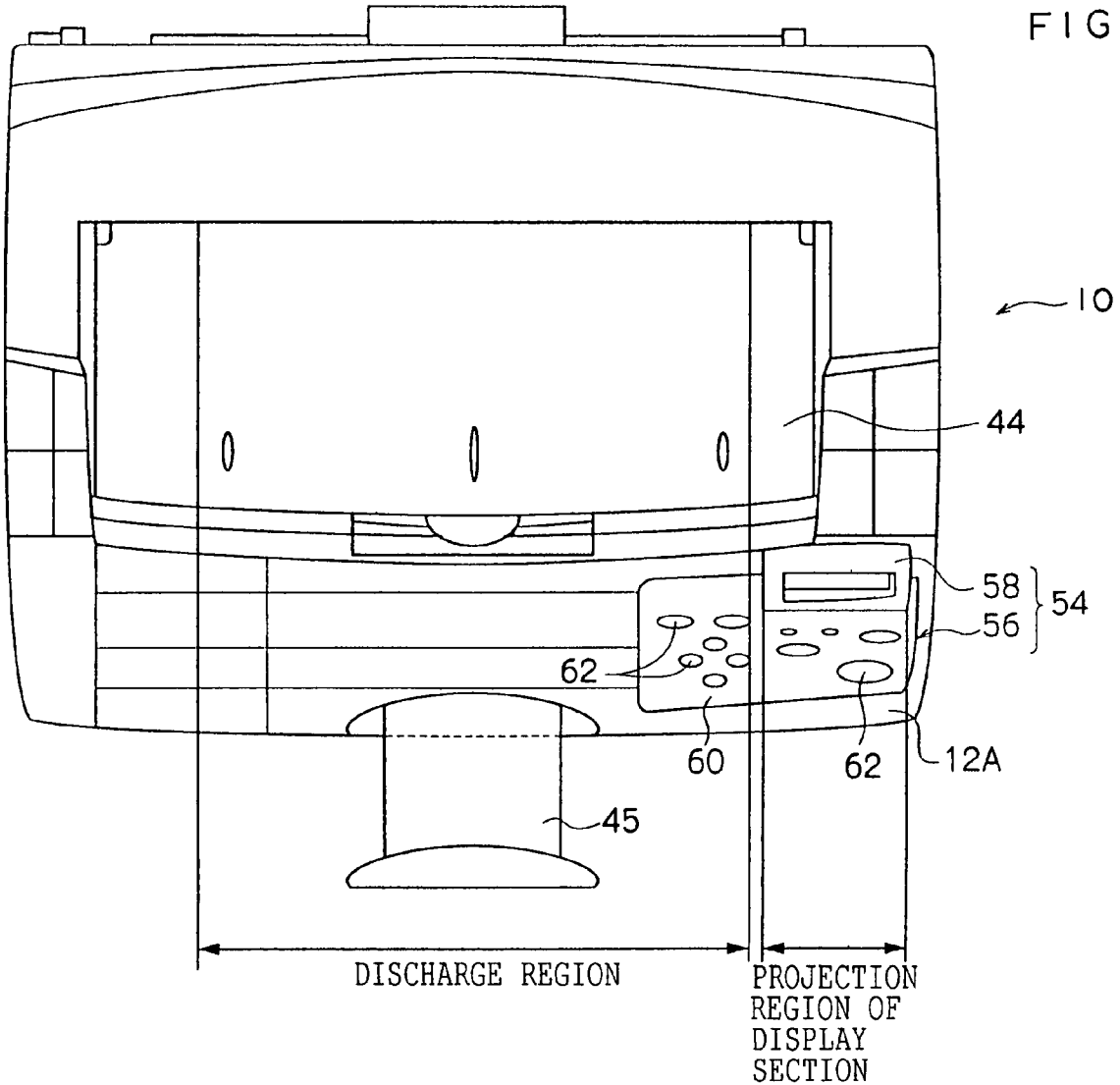
FIG. 2 is a plan view which illustrates the image formation apparatus to which the operation panel in the embodiment of the invention is attached.

As shown in FIGS. 1 to 3, the operation panel 54 is provided at a front (the lower side in FIGS. 1 and 2 ) right corner on a front top surface 12A of the image formation apparatus 12. The top surface of the image formation apparatus main body 12 is inclined so that the front surface 12A, which is at the front side of the apparatus main body, is lower than the rear top surface, which is at the rear side of the apparatus main body (see FIG. 1). The operation panel 54 is inclined so that the front portion thereof, which is at the front side of the apparatus main body, is lower than the rear portion thereof, which is at the rear side of the apparatus main body.

The operation panel 54 consists of an operation section 56 which sets an operation mode (a print mode, a power saving mode, or the like) of the image formation apparatus 10 and a display section 58 which displays the operation mode set by the operation section 56. The display section 58 is arranged to be located outside of a discharge region to which sheets are discharged, and raised at about 50 degrees relative to the horizontal plane (as will be described later).

The discharge region refers to a region to which the sheets are discharged. Specifically, the discharge region represents regions of the top surface 12A and the extension tray 45 of the image formation apparatus main body 12A, which regions could be covered by a discharged sheet projecting from the discharge tray 44. By arranging the display section 58 outside of the discharge region, it is possible to prevent the display section 58 from being covered with the discharged sheets and thus ensure the visibility of the display section 58.

Figure 4:
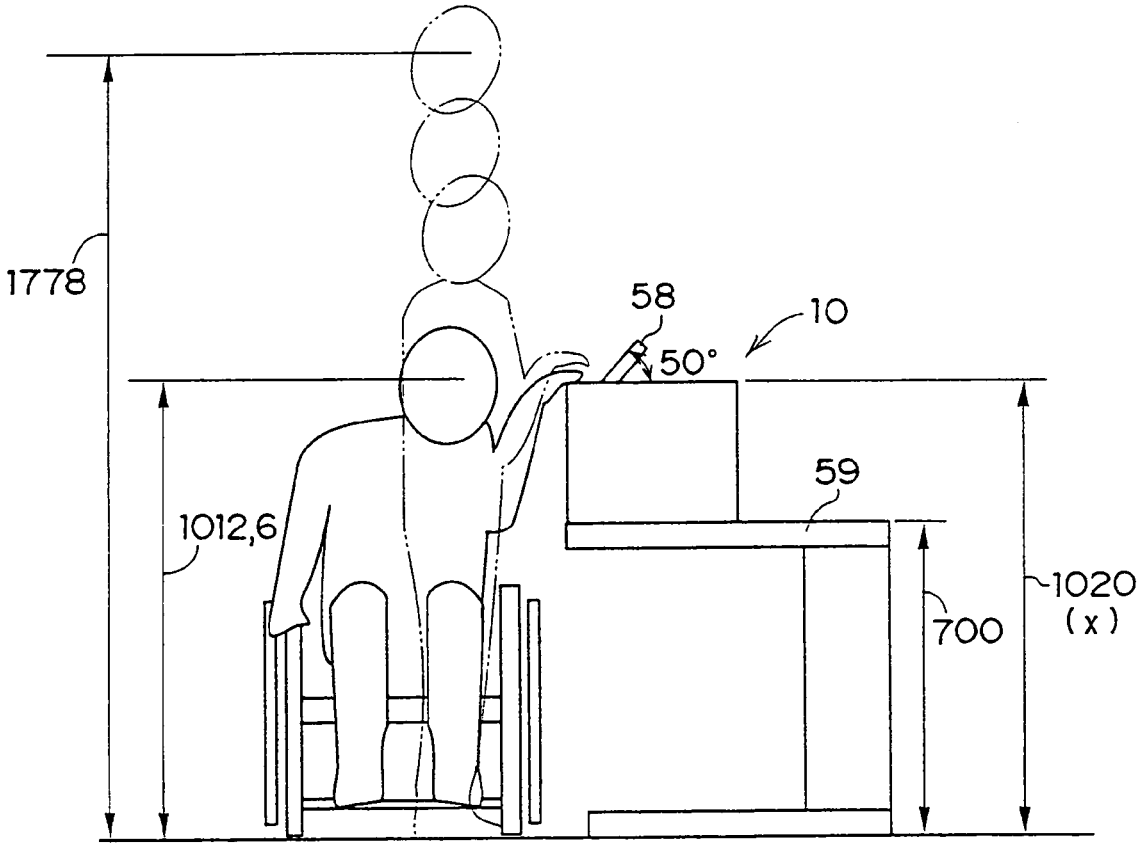
FIG. 4 is an explanatory view for evaluating the visibility of a display section of the operation panel in the embodiment of the invention.

As shown in FIG. 4, a display section height (x) differs according to sizes and numbers of the paper feed trays. If the tray 34 has a capacity of 250 sheets, the display section height (x) of the image formation apparatus 10 is 990 millimeters (290 millimeters of a height to the display section 58 of the image formation apparatus 10+700 millimeters of a height of a disk 59 according to Japanese disk standards). If the tray 34 has a capacity of 550, the display section height (x) of the image formation apparatus 10 is 1020 millimeters (320 millimeters of a height to the display section 58 of the image formation apparatus 10+700 millimeters of the height of the disk 59 according to Japanese disk standards).

If the optional tray 36 having a capacity of 550 is attached to the image formation apparatus 10, the display section height (x) of the image formation apparatus 10 is 1115 millimeters (415 millimeters of a height to the display section 58 of the image formation apparatus 10+700 millimeters of the height of the disk 59 according to Japanese disk standards). If the tray 38 having a capacity of 550 sheets is further attached to the image formation apparatus 10 in addition to the tray 36, the display section height (x) is 1205 millimeters (505 millimeters of a height to the display section 58 of the image formation apparatus 10+700 millimeters of the height of the disk 59 according to the Japanese disk standards).

Figure 5:
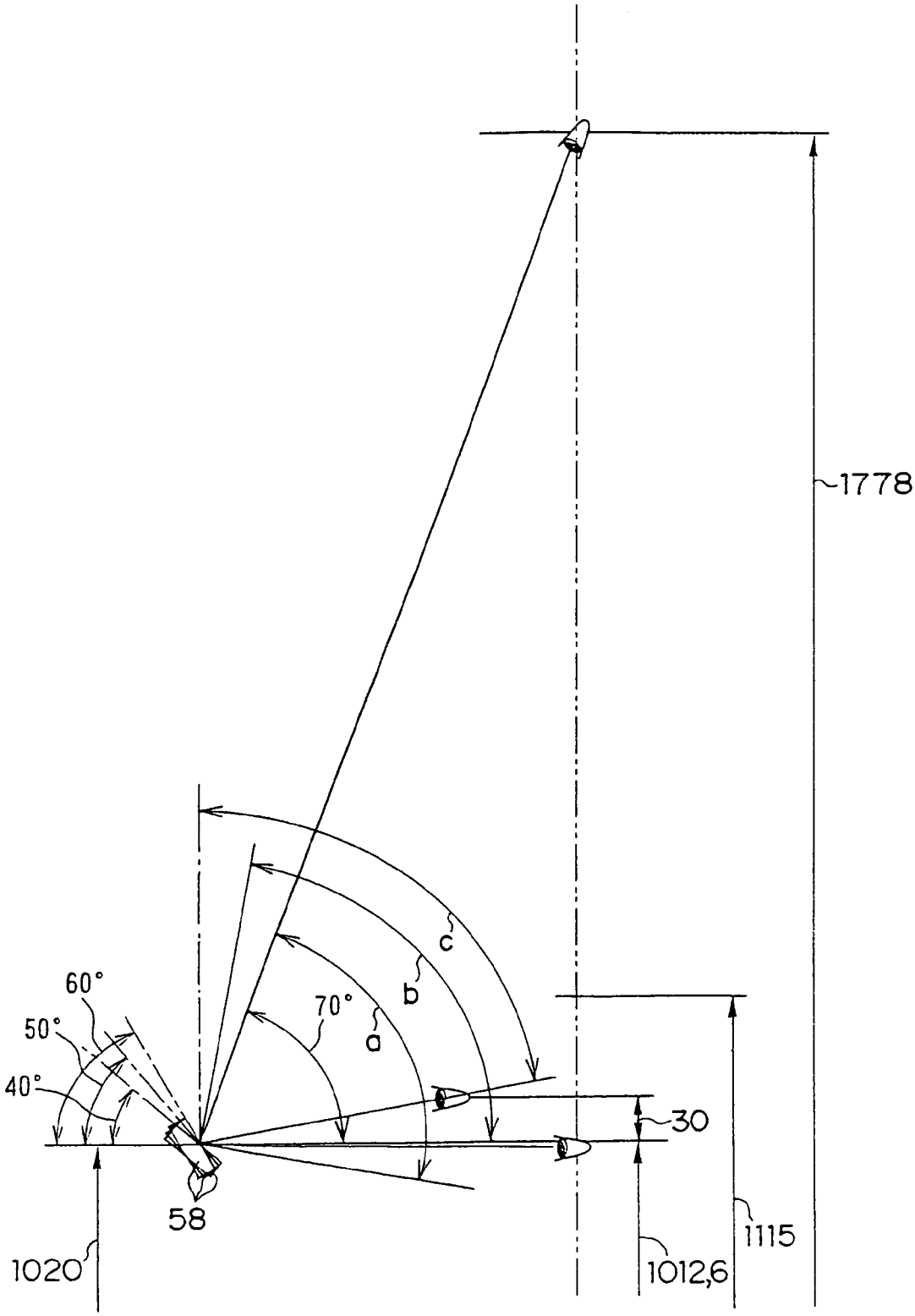
FIG. 5 is an explanatory view for evaluating the visibility of the display section of the operation panel in the embodiment of the invention.

As shown in FIGS. 4 and 5, when a standing angle of the display section 58 relative to the horizontal plane is about 50 degrees, the largest angle of visibility, which is 80 degrees (with an angle α of 40 degrees formed between the line normal to the display surface of the display section 58 and the visibility range limit), is represented by a symbol b. In this condition, if the visibility of the display section 58 is evaluated at the standing position with the display section height (x) set at 1020 millimeters, a line-of-sight angle is 70 degrees relative to the horizontal plane when a height of the standing position viewpoint is 1778 millimeters (which is an upper limit of the height of the operator's eye at the standing position for Japanese male users (ages: 20 to 69 years old; and a range of objectives: 95 percents of the objectives)). Therefore, even if the standing angle of the display section 58 is set at 60 degrees, the aforementioned line-of-sight angle falls within the range of the angle of visibility of 80 degrees (a range a).

On the other hand, if the operator looks into the display section 58 from the wheelchair seated position (at the height of the seated position viewpoint of 1012.6 millimeters, which height is a lower limit of the height of the operator's eye at the seated position for Japanese female users(ages: 20 to 69 years old; and a range of objectives: 95 percents of the objectives)) (i.e., at a height of 1012.6 mm+30 mm=1042.6 mm), the operator can visually recognize the display section 58 even when the standing angle of the display section 58 is 40 degrees (i.e., when the angle of visibility is in a range c). However, in this condition, if the display section height (x) of the image formation apparatus 12 exceeds 1115 millimeters, the display section 58 is located out of the visible range and the operator can no longer visually recognize the display section 58.

Next, a method of setting the standing angle A of the display section 58 relative to the horizontal plane will be described.

Figure 6:
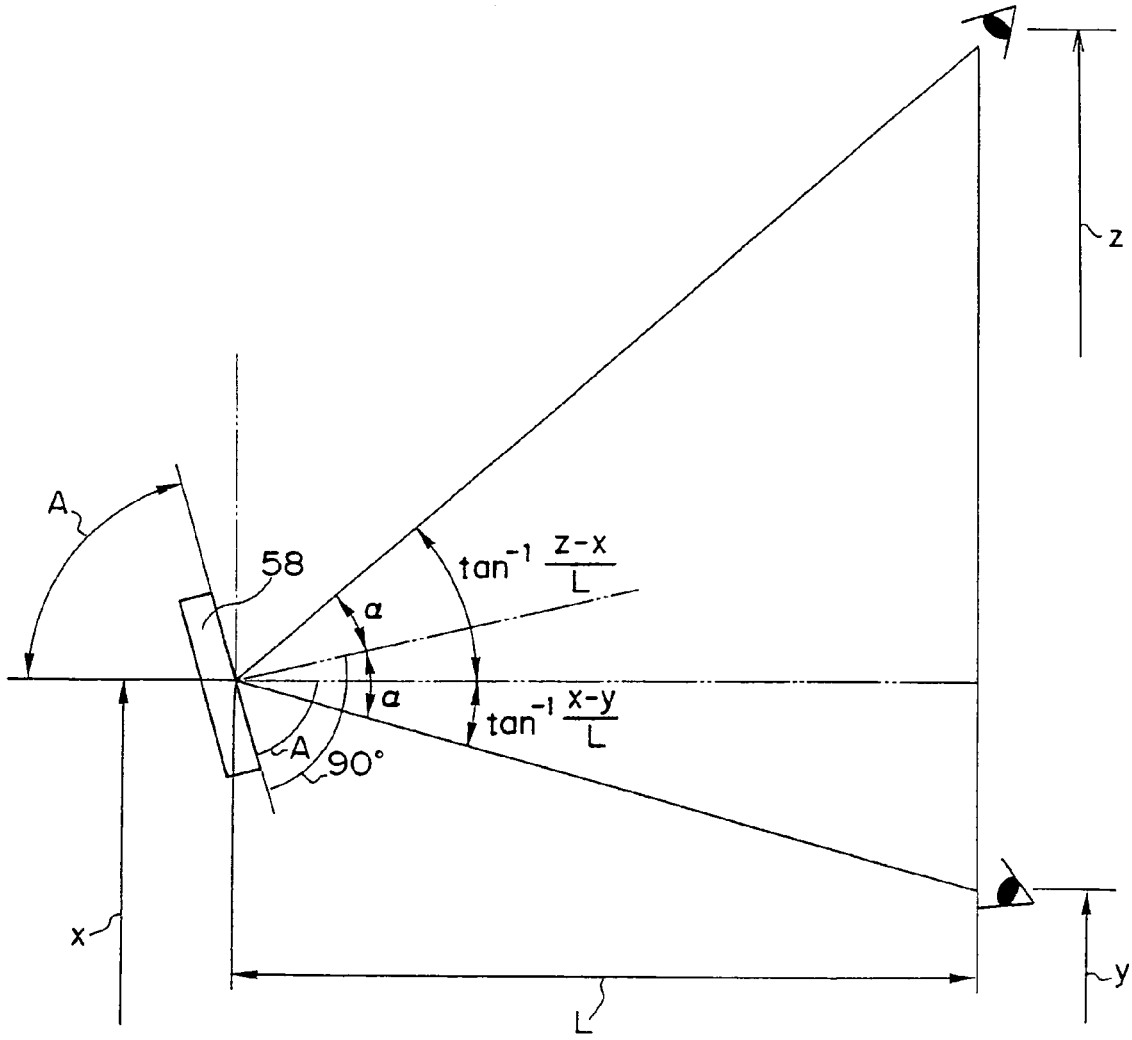
FIG. 6 is an explanatory view for calculating a standing angle of the display section of the operation panel in the embodiment of the invention.

FIG. 6 illustrates the relationship between the standing angle A of the display section and the display section height (x). If the standing angle A of the display section 58 satisfies the following expression, it is possible to ensure the visibility of the display section 58 both at a height (y) of the operator's eye at the wheelchair seated position and at a height (z) of the operator's eye at a position at which a non-handicapped person stands up.

$$90 + \alpha - \tan^{-1}\frac{z-x}{L} \geq A \geq 90 - \alpha + \tan^{-1}\frac{x-y}{L} \quad (1)$$

In Expression (1), A represents the standing angle of the display section (in degrees), α represents an angle (in degrees) formed between the line normal to the display surface of the display section and the visibility range limit, x represents the display section height, y represents the height of the seated position viewpoint, z represents the height of the standing position viewpoint, and L is a horizontal distance from the display section 58 to the operator's eye.

As shown in FIG. 7A, a calculation result based on Expression (1) demonstrates that, at the angle of visibility of 80° (i.e., with the angle α formed between the line normal to the display surface of the display section and the visibility range limit being 40°), if the display section height x is 1115 millimeters or more, the standing angle A does not satisfy Expression (1). However, as shown in FIG. 7B, at the angle of visibility of 120° (with the angle α formed between the line normal to the display surface of the display section and the visibility range limit being 60°), even if the display section height x is 1205 millimeters, the standing angle A satisfies Equation (1).

Consequently, if the angle of visibility of the display section 58 is 80°, the standing angle of the display section 58 is preferably in a range of about 45 to 60 degrees. If the angle of visibility is 120°, the standing angle is preferably in a range of about 35 to 85 degrees.

The standing angle of the display section 58 can be further specified according to the display section height x. In the present embodiment, the angle of visibility of the display section 58 is set at 80 degrees and the standing angle thereof relative to the horizontal plane is set at about 50 degrees, as an example, so that the operator can visually recognize the display section 58 until the display height reaches 1020 millimeters, even while the operator is seated in the wheelchair.

Figure 8A:
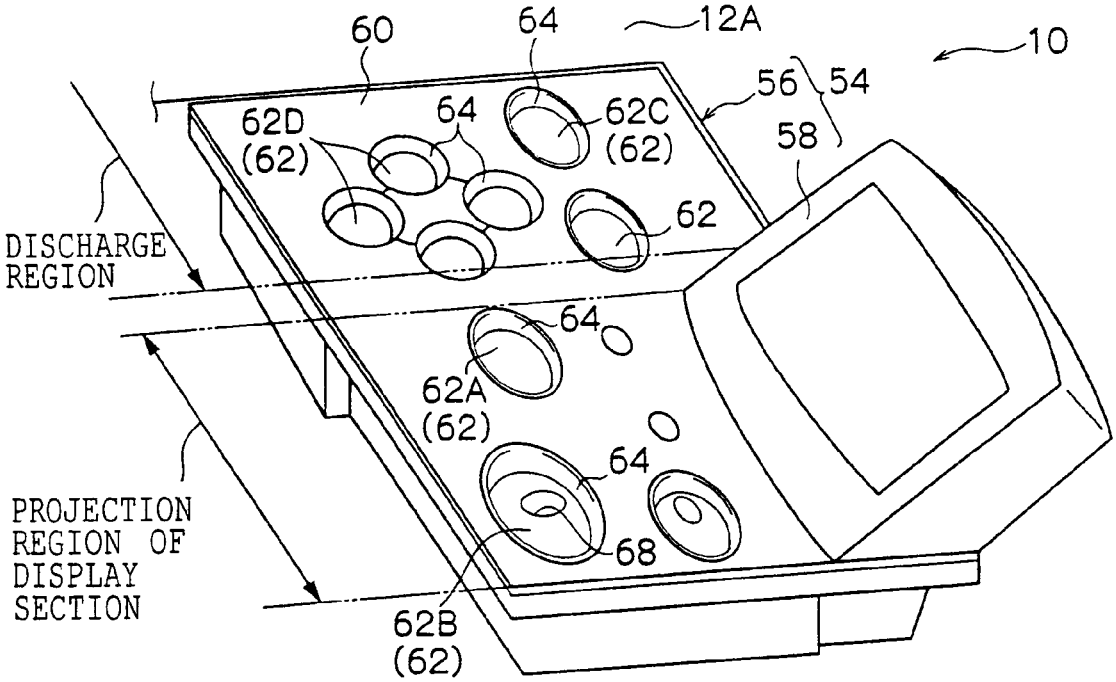
FIG. 8A is a perspective view of the operation panel in the embodiment of the invention.
Figure 8B:
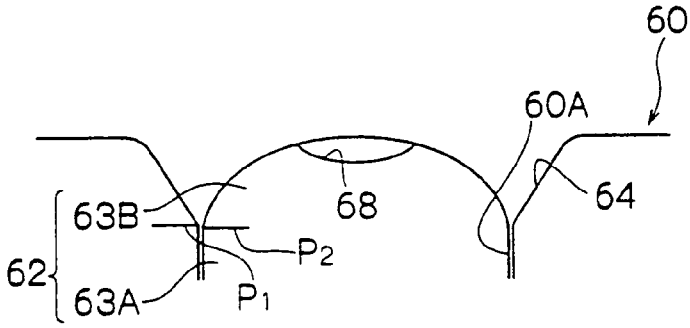
FIG. 8B is an explanatory view which illustrates the relationship between an operation key and a key cover of the operation panel shown in FIG. 8A.
Figure 9:
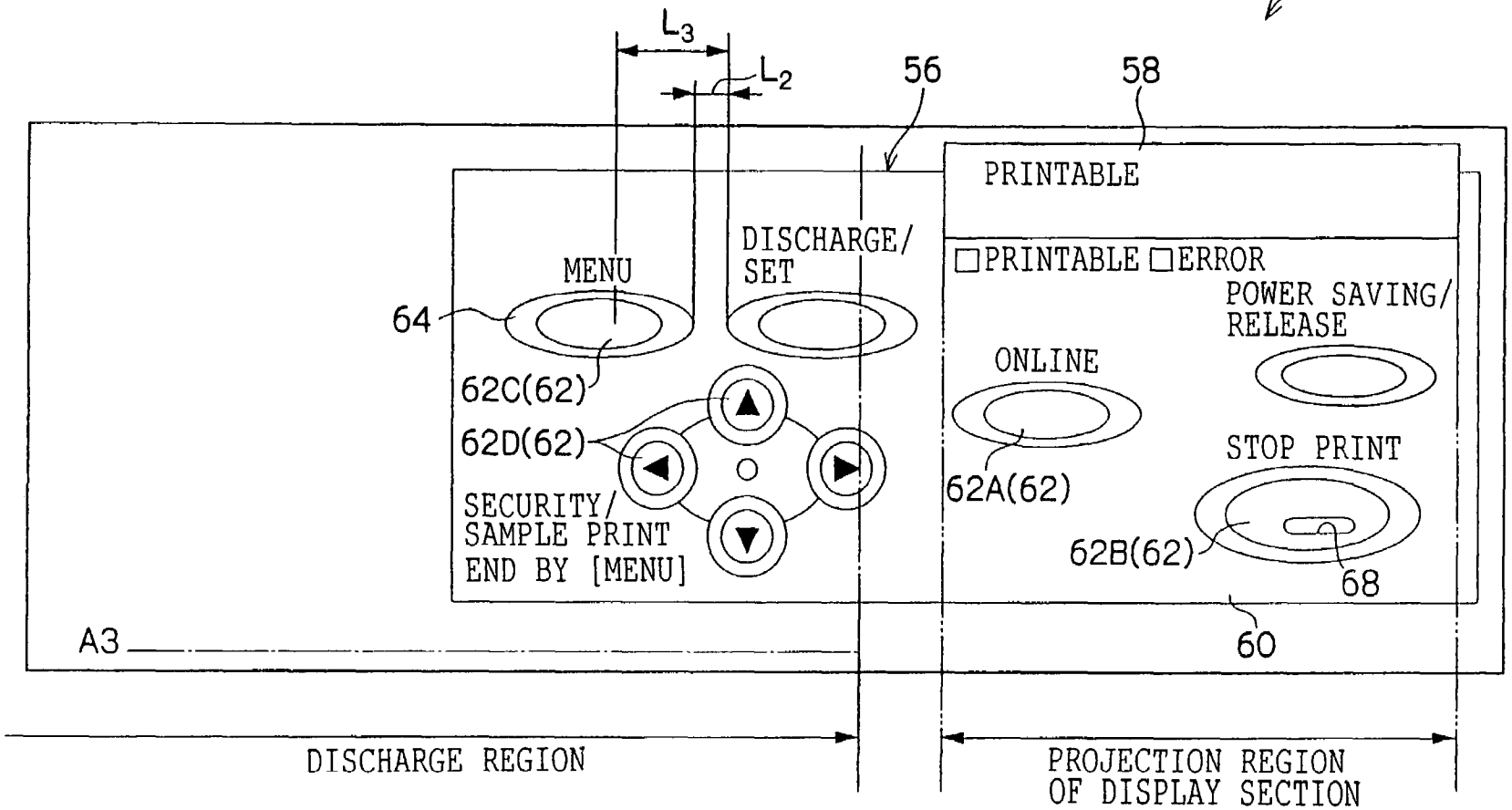
FIG. 9 is a plan view of the operation panel in the embodiment of the invention.

Meanwhile, as shown in FIGS. 8A, 8B, and 9, the operation section 56 of the operation panel 54 is provided with a key cover 60 having a flat plate-like shape. The key cover 60 is arranged to be flush with or below the top surface 12A of the image formation apparatus main body 12 so that the key cover 60 does not protrude from the top surface 12A of the main body 12. In addition, a plurality of holes 60A are formed in the key cover 60 and operation keys 62 for setting the operation mode are arranged in the respective holes 60A.

In the present embodiment, the key cover 60 is provided separately from the image formation apparatus main body 12. However, the key cover 60 need not be always separated from the image formation apparatus main body 12 and may be provided integrally with the image formation apparatus main body 12. In the latter case, even if the key cover 60 is not arranged to be flush with or below the top surface 12A of the image formation apparatus main boy 12, there is no fear that the tip end of the discharged sheet is caught in the cover 60.

The operation keys 62 are classified to visual recognition keys (a menu key 62C, a selection key 62D, etc.) to be operated while the operator is viewing the display section 58 and non-visual recognition keys (an online key 62A, a print stop key 62B, etc.) which do not require the operator to view the display section 58 during the operation thereof. The visual recognition keys (the menu key 62C, the selection key 62D, etc.) are arranged out of a projection region of the display section whereas the non-visual recognition keys (the online key 62A, the print stop key 62B, etc.) are arranged within the projection region.

Figure 10:
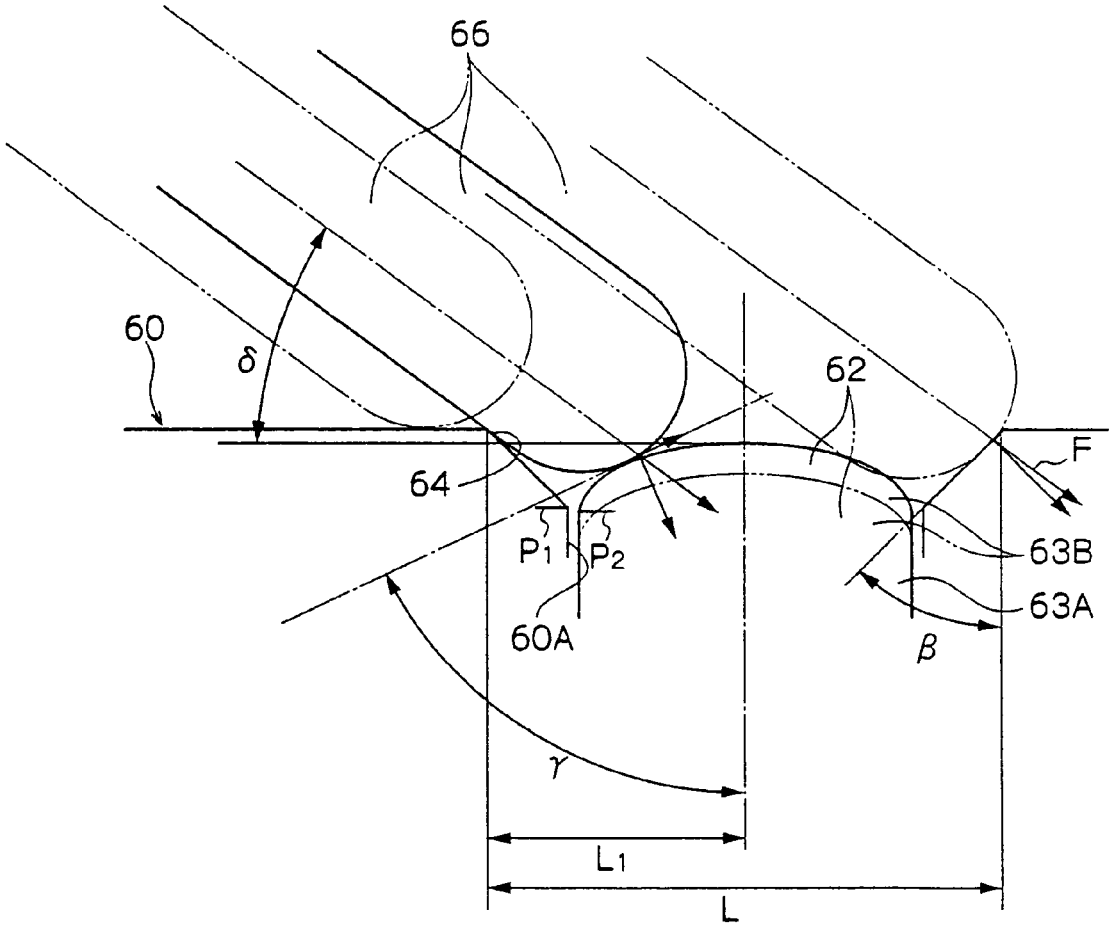
FIG. 10 is an explanatory view which illustrates the relationship between the operation key on the operation panel and a stick in the embodiment of the invention.

As shown in FIGS. 8A, 8B, and 10, each of the operation keys 62 includes a curved, inclined convex portion 63B a having a protruding central portion and provided on a tip end of a cylindrical body 63A. The inclined convex portion 63B is arranged to be flush with or below a surface of the key cover 60 so as not to protrude from the surface of the key cover 60.

If depths of the operation keys 62 are too large, the key cover 60 around the keys 62 obstructs the operator when the operator depresses one of the operation keys 62 with an operator's finger and the operativity is deteriorated. Therefore, in view of irregularity of dimensions and the like, it is preferable to set a depth at which a top of the inclined convex portion 63B is positioned at about 0.5 millimeters from the surface of the key cover 60.

Further, an inverted cone-shaped bank portion 64 is provided in each hole 60A of the key cover 60. A rising part P1 (a boundary between a perpendicular surface and an inclined surface) on a lower side of the bank portion 64 is set higher than a rising part P2 (a boundary between the cylindrical body 63A and the inclined convex portion 63B) of the inclined convex portion 63B.

A tip end of a stick 66 such as a mouth stick or a head stick (which is held in the mouth or fixed to the head by a person having a disabled hand when the person operates a keyboard or the like) having a diameter of 3.5 millimeters (⅛ inches) is caught in between the bank portion 64 and an outer peripheral surface of the operation key 62.

Even if the stick 66 is inclined at, for example, 30±5 degrees relative to the surface of the key cover 60 (the angle at which the stick 66 is inclined will be expressed as δ hereinafter), the operation key 62 can be reliably pushed down by the stick 66. Further, even if the stick 66 slips over the top of the inclined convex portion 63B, the operation key 62 can reliably be pushed down due to the stick 66 being blocked by the rear side of the bank portion 64.

If a tilt angle of the bank portion 64 is expressed as β and a static friction factor between the stick 66 and the bank portion 64 is expressed as μ, the tilt angle β and the static friction factor μ are preferably set to satisfy the following expression:

$$\beta<\tan^{-1}\mu+\delta \tag{2}$$

Namely, while assuming that a pressing force with which the stick 66 pressurizes the bank portion 64 is F, if a maximum frictional force, i.e., Fcos (β−δ)×μ, which acts on the bank portion 64, is higher than an upward component force Fsin (β−δ), of the pressing force F, which component force acts along the bank portion 64, the stick 66 does not slide on the bank portion 64 and the following relationships are, therefore, satisfied:

$$F\cos(\beta-\delta)\times\mu>F\sin(\beta-\delta) \tag{3}$$

$$\mu>\frac{\sin(\beta-\delta)}{\cos(\beta-\delta)} \tag{4}$$

$$\mu>\tan(\beta-\delta) \tag{5}$$

$$\beta<\tan^{-1}\mu+\delta \tag{2}$$

Here, if the tilt angle β of the bank portion 64 is smaller (sharper), a trough formed by the bank portion 64 is deeper. Accordingly, the magnitude by which the stick 66 falls down is larger and the operativity is deteriorated. In addition, with small tilt angle β, when the stick 66 abuts on the bank portion 64, an impact applied to the stick 66 increases. Therefore, it is preferable that the tilt angle β of the bank portion 64 is set as large (gentle) as possible within a range in which the stick 66 does not slide on the bank portion 64.

On the other hand, a tangential angle γ formed between the vertical direction and a tangential line at a point at which the tip end of the stick 66 abuts on the operation key 62 is preferably set, as in the case of the tilt angle β of the bank portion 64, to satisfy the following expression so that the stick 66 can push the operation key 62 without sliding on the outer peripheral surface of the operation key 62:

$$\gamma<\tan^{-1}\mu'+\delta \tag{6}$$

In the expression (6), μ' is the static friction factor between the stick 66 and the operation key 62.

Figure 11:
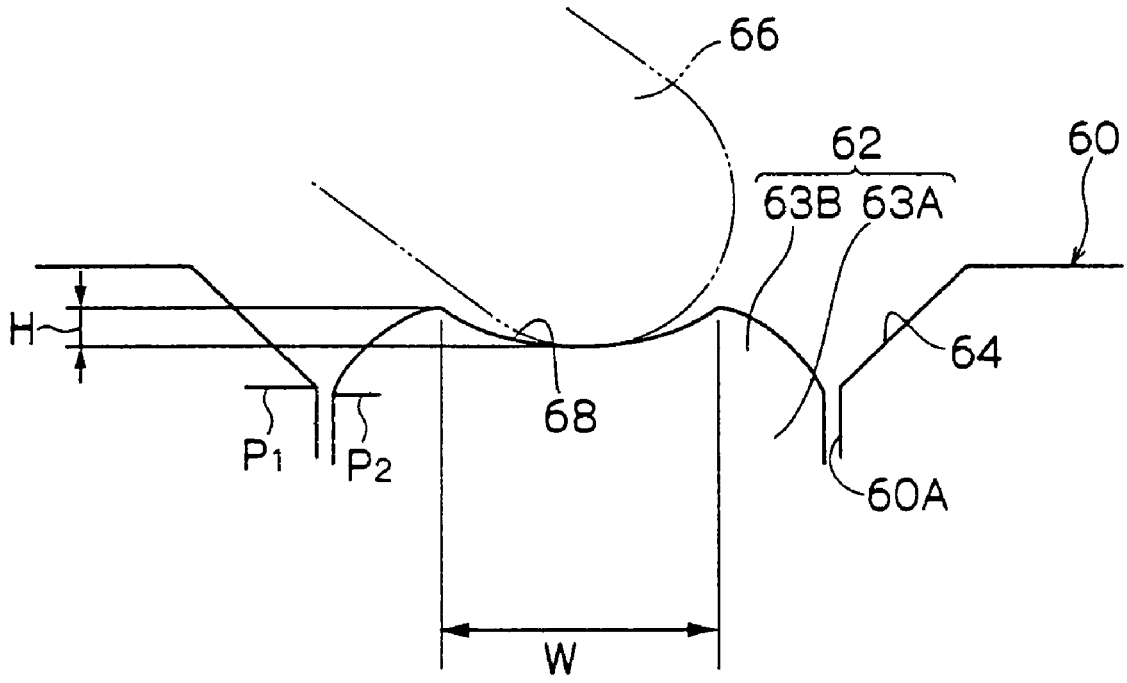
FIG. 11 is another explanatory view which illustrates the relationship between the operation key and the stick in the image formation apparatus in the embodiment of the invention.

Furthermore, as shown in FIG. 11, a curved concave portion 68 with which the tip end of the stick 66 can be engaged may be provided on the top of the inclined convex portion 63B of the operation key 62 so that the stick 66 can depress the operation key 62 without sliding on the outer peripheral surface of the operation key 62. By so providing, the operation key 62 can be depressed with the tip end of the stick 66 caught in the concave portion 68.

A width W of the concave portion 68 is preferably 3.5 millimeters or more so that the tip end of the stick 66 can be caught in the concave portion 68. Meanwhile, since the operation key 62 is recessed as compared with the surface of the key cover 60, the bank portion 64 of the key cover 60 may serve as an obstacle when the operator pushes the operation key 62 down with his/her finger, to thereby deteriorate the controllability. Therefore, as shown in FIG. 10, the largest distance L between the facing bank portions 64 is preferably kept ten millimeters or more.

This largest distance L need not be kept at 10 millimeters in either lengthwise or crosswise. It suffices to secure the 10 mm or more distance only in the crosswise direction viewed from the front side of the image formation apparatus 10. With this arrangement, even if the image formation apparatus 10 is small in size, it is still possible to ensure the good operativity of the operation key 62 substantially equal to that in the large-sized image formation apparatus 10.

It is also preferable that a distance L1 from a boundary between the surface of the key cover 60 and the bank portion 64 to the center of the operation key 62 is set at 3.5 millimeters or more so that the tip end of the stick 66 can reliably be caught in between the bank portion 64 and the operation key 62.

As shown in FIG. 9, a distance L2 between one boundary of one bank portion 64 with respect to the surface of the key cover 60 and the other boundary of the other bank portion 64 with respect to the surface of the key cover 60, is set at six millimeters or more. Further, a distance L3 from one boundary between one bank portion 64 and the surface of the key cover 60, to the center of the other operation key 62, is set at nine millimeters or more.

The function of the image formation apparatus 10 in the embodiment of the invention will next be described.

As shown in FIGS. 1 and 2, by arranging the display section 58 on the front face side of the image formation apparatus main body 12, the display section 58, the visibility of which can be ensured both at the seated position at which the operator is seated in the wheelchair or the like and at the standing position, can be obtained relatively easily. Specifically, by raising the display section 58 relative to the horizontal plane, the operator can visually recognize the display section 58 even while the operator is seated in, for example, the wheelchair as shown in FIGS. 4 and 5.

If the display section 58 consists of a liquid crystal having an angle of visibility of 80 degrees (with an angle formed between the line normal to the display surface of the display section and the visibility range limit being 40 degrees), the display section 58 is raised at about 50 degrees relative to the horizontal plane, so that the visibility both at the wheelchair seated position at which a handicapped person is seated in the wheelchair and at the standing position at which the non-handicapped person stands up can be ensured. Accordingly, the operation panel in a so-called universal design, which causes no discrimination among the handicapped, the elderly, and the non-handicapped people, can be provided.

As shown in FIG. 9, by classifying the operation keys 62 to the visual recognition keys (the menu key 62C, the selection key 62D, etc.) operated while the operator is viewing the display section 58 and the non visual recognition keys (the online key 62A, the print stop key 62B, etc.) which do not require the operator to view the display section 58 during the operation thereof, and by arranging the visual recognition keys (the menu key 62C, the selection key 62D, etc.) outside of the projection region of the display section 58, the disadvantage that the display section 58 is hidden by the operator's hand when the operator operates the visual recognition key and the operation is thereby disturbed does not occur.

Further, the distance between the operation keys 62 is set relatively wide. Therefore, even if a physically handicapped person operates the operation section 56, it is possible to prevent such a malfunction as pushing a plurality of operation keys 62 simultaneously from occurring, whereby the controllability of the operation keys 62 can be improved.

As shown in FIGS. 8A and 8B, by arranging the upper surface of each operation key 62 below or to be flush with the surface of the key cover 60, it is possible to prevent the operation key 62 from protruding from the surface of the key cover 60.

As a result, when the operator operates the operation key 62 with the stick 66 by moving the tip end of the stick 66 along the surface of the key cover 60, good operativity is ensured in the operation key 62 which is flush with or below the surface of the key cover 60 since there is no possibility that the operation key 62 disturbs the movement of the stick 66, as compared with the operation key protruding from the surface of the key cover 60.

Further, as shown in FIGS. 8A, 8B, the inverted cone-shaped bank portion 64 is provided in each hole 60A of the key cover 60, so that the stick 66 can depress the operation key 62 with the tip end of the stick 66 caught in between the bank portion 64 and the outer peripheral surface of the operation key 62.

As described above, by allowing the operator to operate the operation key 62 even with the stick 66, the operation panel compliant with the universal design can be provided and an office environment friendly even to the handicapped can be provided.

Further, by providing the curved, inclined convex portion 63B having the protruding central portion, on the tip end of the cylindrical body 63A of each operation key 62, and providing the inverted cone-shaped bank portion 64A in each hole 60A of the key cover 60, the movement of the tip end of the stick 66 can be made more smooth. This smooth movement reduces the impact applied to the stick 66 and ensure good operativity.

Yet further, by setting the rising part $P_1$ (the boundary between the perpendicular portion and the inclined portion) on the lower side of the bank portion 64 higher than the rising part $P_2$ (the boundary between the cylindrical body 63A and the inclined convex portion 63B) of the inclined convex portion 63B, it is possible to prevent the stick 66 from being caught in the outer peripheral surface of the operation key 62.

Yet further, by providing the concave portion 68, with which the tip end of the stick 66 can be engaged, on the top of the inclined convex portion 63B of the operation key 62, the operator can push the operation key down by making the tip end of the stick 66 be caught by the concave portion 68, even in cases, for example, in which an outside diameter of the stick 66 is larger than 3.5 millimeters or an angle $\delta$ of the stick 66 with respect to the surface of the key cover 60 is larger than 30±5 degrees.

As described above, by arranging various methods of operatively pushing the operation key 62 with the stick 66, the operation panel 54 can be made still easier to handle.

In the present embodiment, the standing angle of the display section 58 relative to the horizontal plane is set at about 50 degrees. However, this angle (50 degrees) is only an example. The standing angle of the display section 58 may change in accordance with the angle of visibility of the display section 58. In short, it suffices as long as the standing angle of the display section 58 can achieve visibility of the display section 58 both at the wheel chair-seated position and the standing position at which the non-handicapped person stands up, and the standing angle of the display section 58 is not limited to about 50 degrees.

Further, in the embodiment of the invention, the visual recognition keys (the menu key 62C, the selection key 62D, etc.) are arranged outside of the projection region of the display section 58, so that the operation section 58 is not hidden by the operator's hand when the operator operates the visual recognition key. However, the arrangement of the visual recognition keys is not limited to this arrangement, as long as a situation in which the operator's had hides the display section 58 is prevented.

Figure 12:
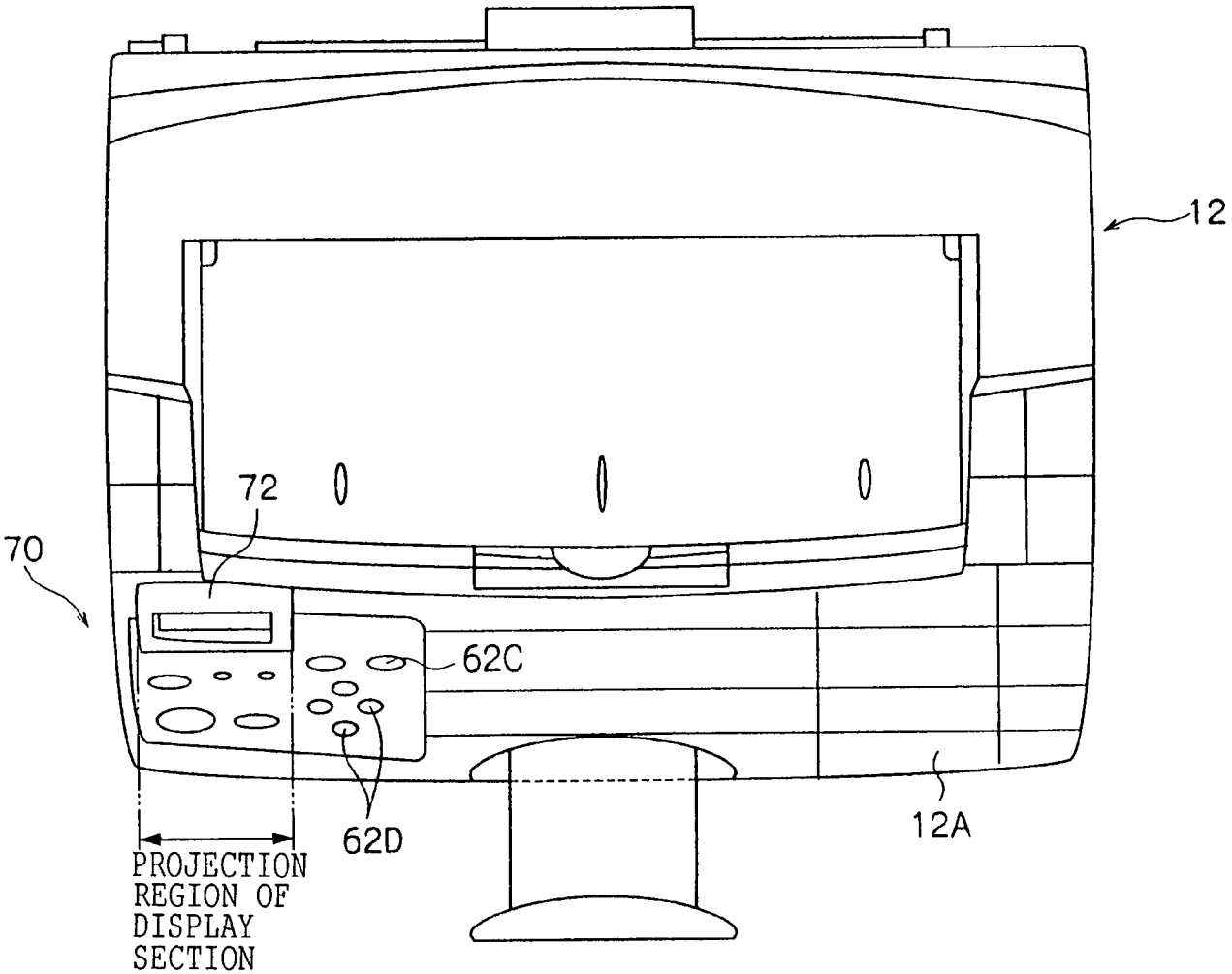
FIG. 12 is a plan view which illustrates a modified example of the operation panel according to the aforementioned embodiment of the invention.

For example, as shown in FIG. 12, an operation panel 70 may be arranged at the left front corner on the top surface 12A of the image formation apparatus main body 12. In the example of FIG. 12, a display section 72 is arranged on a left rear side of the operation panel 70 and the visual recognition keys (the menu key 62C, the selection key 62D, etc.) are arranged at the right-hand side of the projection region of the display section 72. With this arrangement, good operativity is ensured because an operator's right hand does not cross the operator's sight when the operator operates the operation section with his/her right hand.

Figure 13:
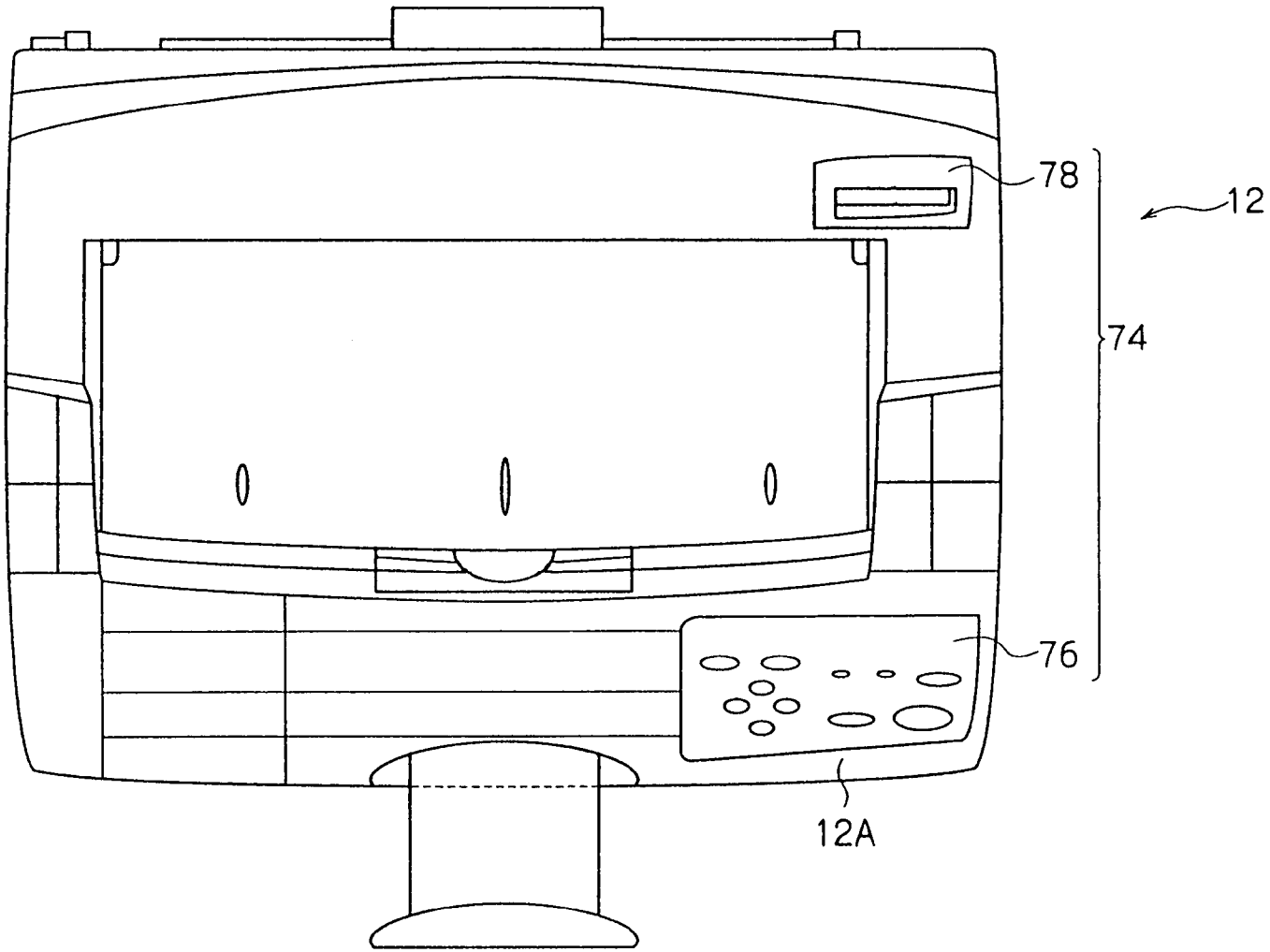
FIG. 13 is a plan view which illustrates another example of the operation panel according to the aforementioned embodiment of the invention.
Figure 14:
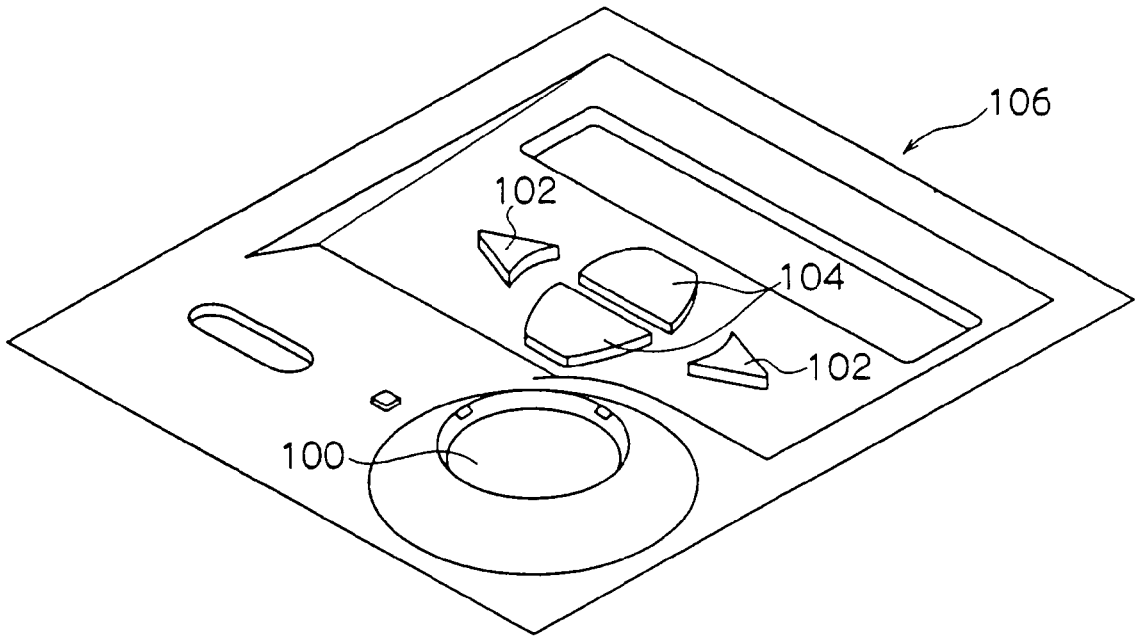
FIG. 14 PRIOR ART
FIG. 14 is a perspective view which illustrates a conventional operation panel.
Figure 15A:
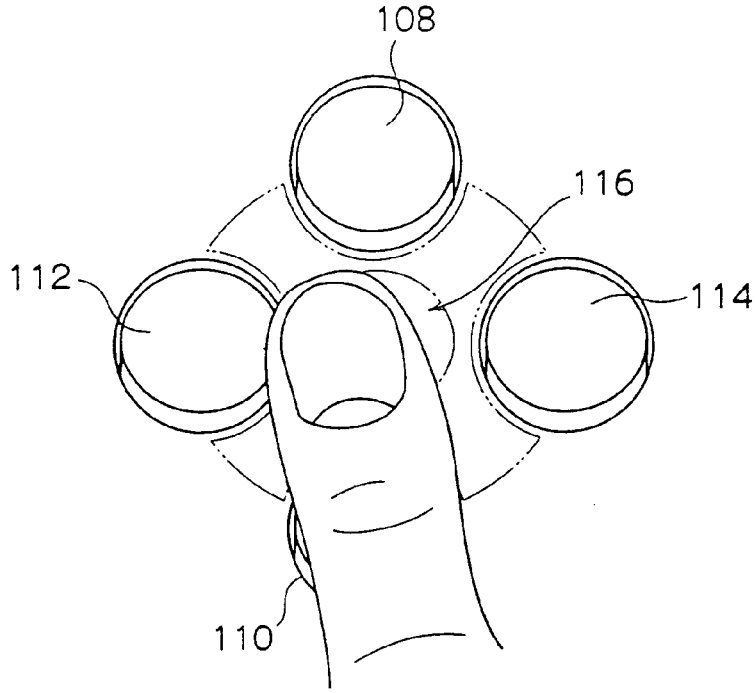
FIG. 15A PRIOR ART
FIGS. 15A and 15B are a plan view and a cross-sectional view of the conventional operation panel, respectively.
Figure 15B:
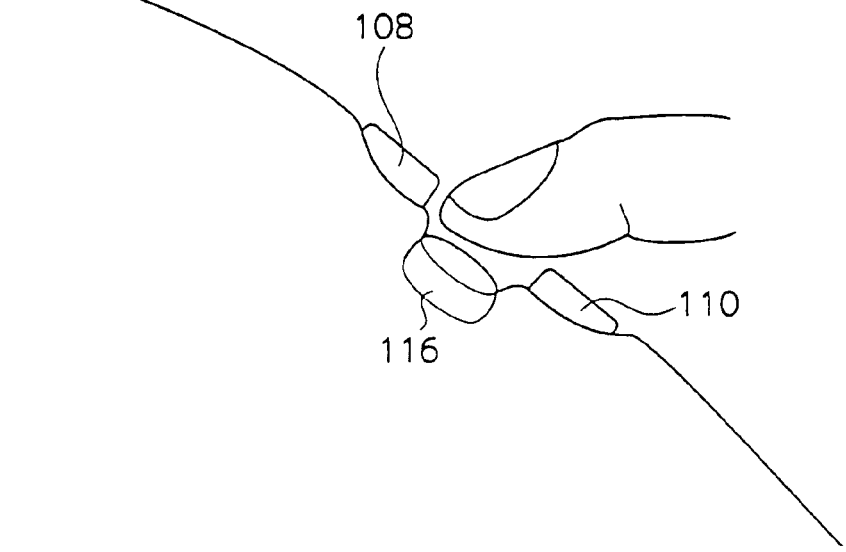
FIG. 15B PRIOR ART

Further, as shown in FIG. 13, only an operation section 76 of an operation panel 74 may be arranged at the front right corner portion of the top surface 12A of the image formation apparatus main body 12 and a display section 78 may be provided in a right rear portion of the image formation apparatus main body 12.

In the example of FIG. 13, by inclining the top surface of the image formation apparatus main body 12 so that the front top surface 12A, which is at the front side of the apparatus main body, is lower than the rear top surface, which is at the rear side of the apparatus main body, the visibility can be ensured both at the wheelchair seated position and the standing position, even if the display section 78 is arranged in the rear portion of the image formation apparatus main body 12.

In the example of FIG. 13, whether the operation key is operated by the operator's right hand or left hand, the display section 78 is never hidden by the operator's hand. Further, as the operation section 76 and the display section 78 are arranged so as to be on the same line along the operator's sight, no operational disadvantage occurs even if the operation section 76 and the display section 78 are provided separated from each other.

In the present embodiment, in the case in which the display section 58 consists of the liquid crystal having an angle of visibility of 80 degrees (i.e., with an angle formed between the line normal to the display surface of the display section 58 and the visibility range limit being 40 degrees), the display section 58 is raised at about 50 degrees relative to the horizontal plane, so that visibility can be ensured both at the wheelchair seated position and at the standing position at which the non-handicapped person stands up (feature 1). In addition, by providing the inverted cone-shaped bank portion 64 in each hole 60A of the key cover 60 such that the operation key 62 can be pushed down with the tip end of the stick 66 being caught between the bank portion 64 and the outer periphery of the operation key 62, the operation panel compliant with the universal design, which causes no discrimination among the handicapped, the elderly, and the non-handicapped, can be provided (feature 2). However, the operation panel of the present invention need not always have the aforementioned two features, and it suffices if the operation panel has at least one of the two features.

Further, in the embodiment of the invention, the angle δ formed between the stick 66 and the surface of the key cover 60 is 30±5 degrees. However, this angle is only an example and the angle δ is not limited to 30±5 degrees.

Furthermore, the operation keys 62 and the bank portion 64 may both be made of plastic. In this case, the static friction factor μ of each operation key 62 can be set substantially equal to the static frictional factor μ' of the bank portion 64, so that the angles β and γ (see FIG. 10) are substantially equal to each other. Besides, if each operation key 62 is made of a high friction member such as rubber, it is possible to set the angle γ larger than the angle β.

In the present embodiment, the image formation apparatus 10 has been described. However, the present invention is not limited to the operation panel 54 of the image formation apparatus 10. That is, the present invention may be applied to an operation panel of an electronic equipment such as a facsimile machine, a telephone, a washing machine, a microwave oven, a keyboard, or an electronic calculator.

In short, according to the present invention having the above-described structure, even if the angle of visibility of the display section is relatively small, the operator can visually recognize the display section while the operator is seated in the wheelchair. The display section is raised with respect to the horizontal level by a standing angle at which the operator can visually recognize the display section at the standing position seated position, as well. As a result, the operation panel compliant with the so-called universal design, which causes no discrimination among the handicapped, the elderly, and the non-handicapped, can be provided.

What is claimed is:

1. An operation panel comprising:

an operation section; and a display section which displays a content of operation effected at the operation section, wherein the display section is raised, at a predetermined angle with respect to a horizontal plane, so that the display section can be visually recognized both from a wheelchair seated position viewpoint of an adult of standard height and from a standing position viewpoint of an adult of standard height in accordance with an angle of visibility of the display section, while the operation panel is attached to an apparatus main body, and the predetermined angle of the display section satisfies the following expression:

$$90 + \alpha - \tan^{-1}\frac{z-x}{L} \geq A \geq 90 - \alpha + \tan^{-1}\frac{x-y}{L} \quad (1)$$

wherein A is the predetermined angle of the display section, x is a height (in millimeters) of the display section measured from a floor, y is a height (in millimeters) of the wheelchair seated position viewpoint measured from the floor, z is a height (in millimeters) of the standing position viewpoint measured from the floor, L is a horizontal distance (in millimeters) between the display section and the viewpoints, and α is the angle of visibility that is an angle (in degrees) formed between a line normal to a display surface of the display section and a visibility range limit.

2. The operation panel according to claim 1, wherein, if the angle of visibility of the display section is 80 degrees, the predetermined angle of the display section is about 45 to 60 degrees, and if the angle of visibility of the display section is 120 degrees, the predetermined angle of the display section is about 35 to 85 degrees.

3. The operation panel according to claim 1, wherein the operation panel is attached to a front face side of the apparatus main body.

4. The operation panel according to claim 1, wherein an operation surface of the operation section is inclined so that, in a state in which the operation section has been mounted to the apparatus main body, a front portion of the operation surface, which is at the front side of the apparatus main body, is lower than a rear portion thereof, which is at the rear side of the apparatus main body.

5. An image formation apparatus, comprising the operation panel according to claim 1.

6. An electronic apparatus, comprising the operation panel according to claim 1.

* * * * *